United States Patent [19]

Stoakes

[11] Patent Number: 4,756,131

[45] Date of Patent: Jul. 12, 1988

[54] WALL WITH MULTIPLE LAYER PANELLING

[76] Inventor: Richard L. Stoakes, "Clouds" Northdown Road, Woldingham, Surrey, England

[21] Appl. No.: 3,415

[22] Filed: Jan. 15, 1987

[30] Foreign Application Priority Data

Jan. 20, 1986 [GB] United Kingdom ..... 8601290
Jun. 16, 1986 [GB] United Kingdom ..... 8614573

[51] Int. Cl.[4] ..... E04B 2/96

[52] U.S. Cl. ..... 52/171; 52/235; 52/398

[58] Field of Search ..... 52/171, 172, 398, 2, 52/302, 303, 235, 209; 49/177

[56] References Cited

U.S. PATENT DOCUMENTS

| | | | |
|---|---|---|---|
| 2,062,747 | 12/1936 | Gelstharp | 52/172 |
| 2,264,176 | 11/1941 | Englehart | 52/171 |
| 2,332,060 | 10/1943 | Colleran | 52/171 |
| 2,699,580 | 1/1955 | Smith | 49/177 |
| 2,700,196 | 1/1955 | Panhard | 52/2 |
| 2,763,038 | 9/1956 | Hagerty | 49/477 |
| 3,442,048 | 5/1969 | Elias | 49/477 |
| 3,604,613 | 9/1971 | McCurdy | 52/172 |
| 4,372,084 | 2/1983 | Janke | 49/477 |

FOREIGN PATENT DOCUMENTS

| | | | |
|---|---|---|---|
| 0075464 | 9/1982 | European Pat. Off. . | |
| 1369790 | 7/1964 | France | 49/477 |

*Primary Examiner*—John E. Murtagh
*Attorney, Agent, or Firm*—Hopgood, Calimafde, Kalil, Blaustein & Judlowe

[57] ABSTRACT

An infill of multiple-layer panels, each with an air space between inner and outer leaves, is provided in a curtain wall frame structure. The panels have peripheral gaskets that provide channels surrounding the internal air spaces of the panels. The channels are connected in at least one group to gas pumping means. In one mode the channels communicate with the panel internal spaces and the pumped gas forms a venting flow through said spaces. In another mode the gas can be held under pressure: this can be to keep the internal spaces filled with a particular gas or for pressure testing, e.g. at the peripheries of the panels.

5 Claims, 3 Drawing Sheets

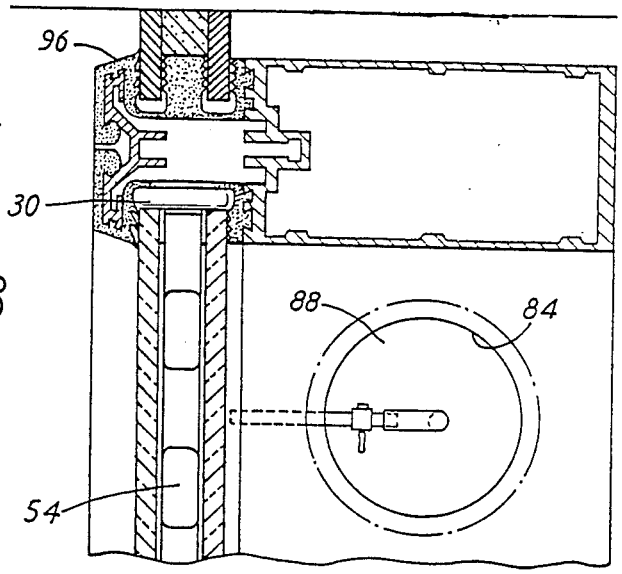
FIG. 3
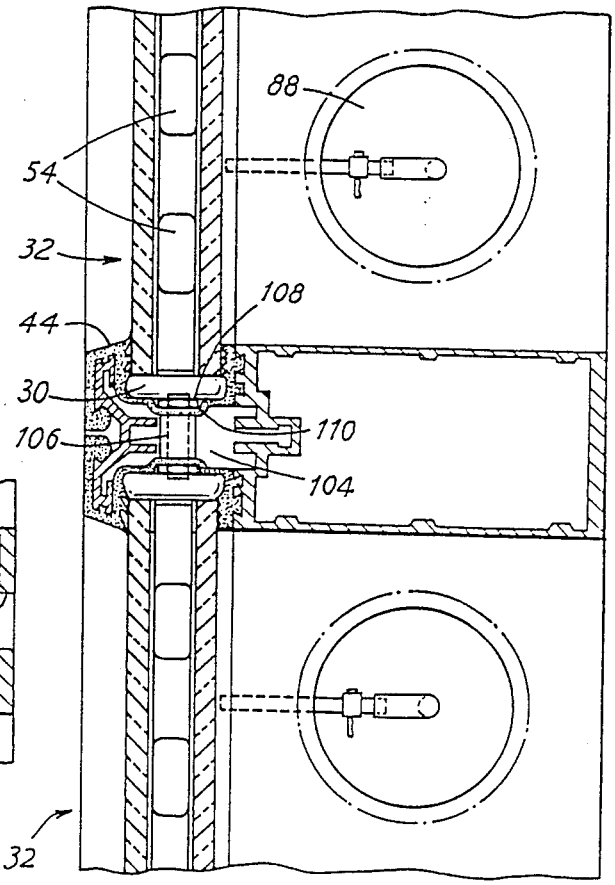
FIG. 4
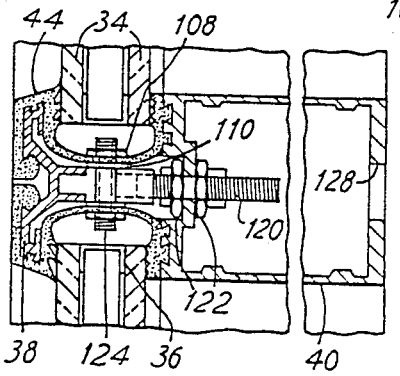

WALL WITH MULTIPLE LAYER PANELLING

BACKGROUND OF THE INVENTION

This invention relates to walls in which a frame structure has an infill, over at least a part of the area of the wall, of multiple layer panels providing an air gap between inner and outer leaves, e.g. being double- or triple-glazed.

While it is normal practice to form such multiple layer panels so that the air spaces within them are completely sealed, imperfections of construction or simply the effects of time often result in leakage and even small flows can give rise to fogging of glass areas. Also, if condensed vapour is allowed to stand in contact with many of the materials used for the wall infill, including the rubbery materials that are commonly relied on to provide sealing, it can cause deterioration.

SUMMARY OF THE INVENTION

According to the present invention, there is provided a wall structure comprising a framework defining a series of cells in which are held infill panels with sealing means between the peripheries of the panels and the framework, at least some of the panels comprising a plurality of layers with spacing means between them to form an internal space between adjacent layers, characterised in that the peripheries of said plural-layer panels internally of said peripheral sealing means are connected by conduit means to gas pumping means to supply a gas to said panel peripheries.

In a preferred form the peripheral sealing means for the spaces are continuous-loop gaskets such as those Case A, Ser. No. 003,414 filed at the same time as this application, which gaskets also form the sealing means between the peripheries of the panels and the framework. The spaces thus enclosed may be used for pressure tests of the sealing, or as manifolds for supplying the internal spaces of the panels, in this latter case at least the spacer means not being in the form of conventional peripheral seals of double-glazing units but allowing a gas flow into said internal spaces.

If it is arranged that there should be a gas throughflow from said pumping means, said panels preferably communicate in at least one group with a common inlet conduit. The panels of the group are preferably connected together by tubes passing through the gasket walls of adjacent spaces; at least some of these tubes may be provided with non-return valves to assist the distribution of the pumped gas through the spaces, if required.

The spaces may be interconnected as a plurality of vertical files connected in parallel to the pumping means, at least some of the vertical connections within each file having non-return valves. To match the gas flows in neighbouring files they may be connected by equalizing unions spaced up the wall. If panel spaces connected in vertical files are sealed by continuous loop gaskets, the spaces between the panel layers may communicate only vertically with the peripheral spaces defined by the gaskets around the panels, for example by having a peripheral spacer for the panel layers that is provided with openings only at the top and bottom. The channels that remain between the panel side edges and the gasket can be blocked so as to confine air flow to the space between the panel layers. Equalizing unions between neighbouring vertical files may then be established through the gaskets into these side channels to avoid excessive cross-flow between the files through the unions.

If the conduit means are arranged to produce a flow of air within the structure it is preferred to provide a filter through which the pumped air passes before flowing through the spaces of the curtain wall. If, however, the pumped medium is employed only for pressure-testing the sealing of the panels or if a static gas is intended to fill the internal spaces of the panels, this precaution is not required.

The invention will be described in more detail, by way of example, with reference to the accompanying drawings.

BRIEF DESCRIPTION OF THE DRAWINGS

FIGS. 2 and 3 are cross-sectional views on the lines A—A and B—B, respectively, in FIG. 1, FIG. 4 is a cross-sectional view, in an orientation similar to FIG. 3, showing a modification.

DESCRIPTION OF THE PREFERRED EMBODIMENTS

Figure 1:
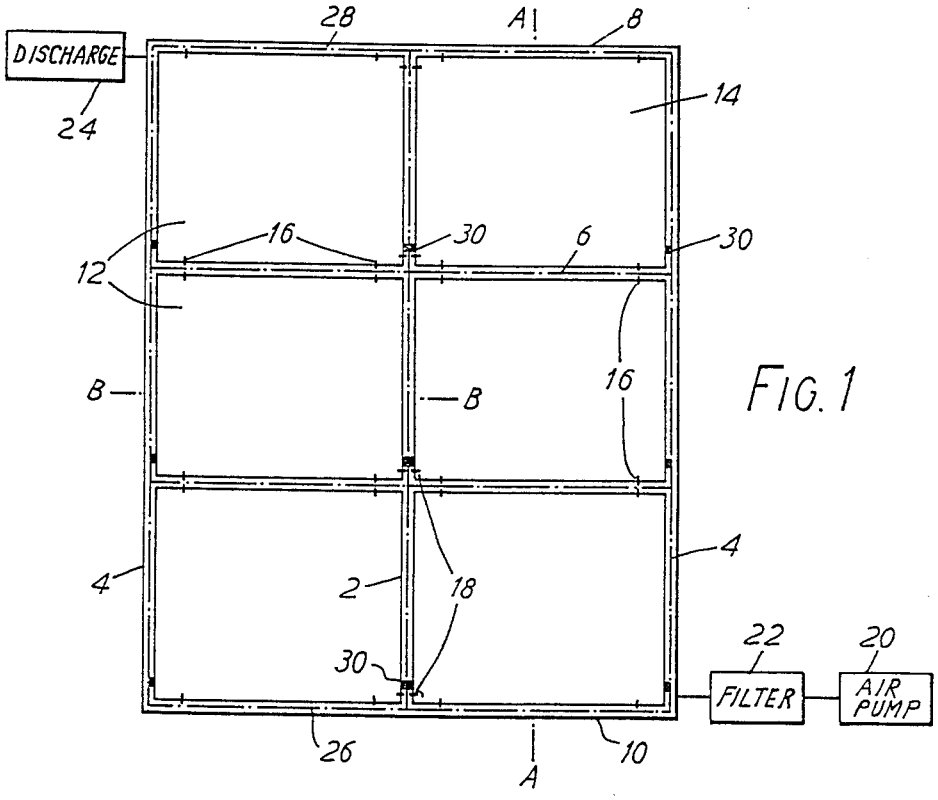
FIG. 1 is a schematic elevation of part of a curtain wall.

Referring firstly to FIG. 1, the curtain wall comprises a frame-like construction of extruded metal sections providing a vertical mullion 2, jamb mullions 4, transoms 6 and top and bottom sills 8, 10 to define a series of rectangular cells 12. Only six cells are shown for simplicity.

As will be described in more detail below, the cells are filled by respective infill panels 14, each of which is double leaved, e.g. as double-glazing, enclosing its own individual air space. The spaces are connected together by a series of connections 16, 18 (shown only schematically in FIG. 1) to form one or more flow paths in the interior of the wall, through which air from a pump 20, connected via a filter 22 with the air spaces of the lower cells of the wall, can pass through all the air spaces of the wall to a discharge outlet 24 at the top of the wall. In the example of FIG. 1, adjacent vertical files of cells have the spaces of each file connected in series by the connections 16, and the spaces of the files are connected in parallel by the connections 18. The air pump and filter are coupled to an inlet manifold 26 formed by the supporting framework for the panels and running along the bottom of the wall and the air flow exits through a discharge outlet coupled to an outlet manifold 28 similarly formed along the top of the wall. The inlet and outlet are at diagonally opposite regions of the group of cells. Blocking inserts 30 are provided at desired locations in the conduits formed by the framework to control the airflow and prevent it bypassing the air spaces in the panels. The horizontal connections 18 serve mainly to equalize pressure between the files.

It will be appreciated that other patterns of interconnection can be provided and that it is possible to interconnect much greater umbers of cells. In large walls it is of course possible to arrange a number of separate groups of interconnected cells each with its own inlet and outlet. It is of course possible to provide any desired number of inlets and/or outlets in any individual cell or group of cells.

Figure 2:
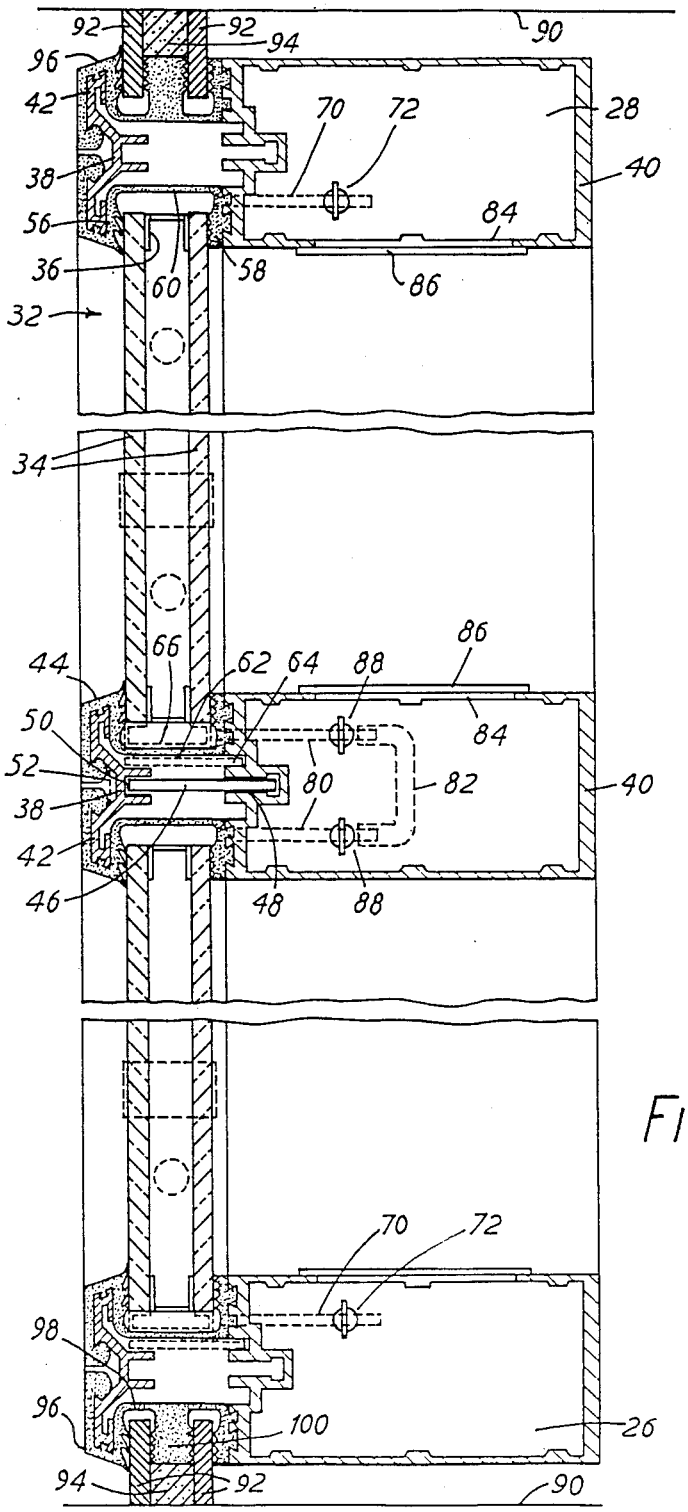

As shown in FIGS. 2 and 3, the panels 32 have inner and outer leaves 34 separated by spacers 36 and are held around their edges by auxiliary members 38 of the framework in an arrangement which may be similar to those described in GB Patent Nos. 1459401 and 1496482 and European Patent Application No. 0194779, the contents of which are incorporated herein by reference. As in these earlier constructions, the edges of the panels are clamped between box-section main frame members 40 and side limbs 42 of the generally T- or Y-form auxiliary members 38, which are secured to the main members by screws (not shown). Flexible sealing gaskets 44 of extruded neoprene are provided between the front and rear edges of each panel and the surfaces of the main frame members and auxiliary members between which these edges of the panel are clamped.

Referring to FIG. 2, a main frame member 40 of a transom and an opposed auxiliary frame member 38 are positioned relative to each other by locating plates 46 in opposed recesses 48, 50 respectively in the main and auxiliary members, and are secured together by screws 52 inserted through apertures in the central front recess of the auxiliary members to grip the sides of the recesses 48. The members 38, 40 clamp between them the edges of two neighbouring double-glazed panels 32. The peripheral spacer 36 extending around the edge of each panel is a U-section channel that takes the place of the seals conventional in such panels. Along the top and bottom edges of the panel only, a series of apertures 54 in the web of the spacer provide access to the space between the leaves. Engaging the front and rear leaves of each panel are front and rear sealing portions 56, 58 of the flexible sealing gasket 44. The gaskets are described in case A, Ser. No. 003,414 the same time as this application, which also describes a framework construction employing the same extruded metal sections, and they are each in the form of a continuous loop extending around the periphery of a respective panel, the front and rear sealing portions being linked by an intermediate web 60 that forms a channel around the edge of the panel. Each gasket thus encloses the air space in its associated double-glazed panel.

For their support, at the bottom edge of each panel, support plates 62 project at intervals from slots 64 in the transom or bottom sill main frame members in which they are frictionally engaged, and the outer ends of the plates rest on the central rear limbs of the associated auxiliary members. The panels bear on the support plates through the gaskets and there are also short panel supports 66 within the gaskets to keep the bottom edges of the panels spaced from the gasket web. The panel supports are hollow so as not to block air flow along the gasket under the bottom edge of the panel, and have a U-section shape with in-turned flanges on which the edges of the inner and outer leaves 34 rest.

Connecting tubes 70 lead into the interior of the gaskets at the bottom edge of the lowermost unit at the bottom sill and at the top edge of the uppermost unit at the top sill. In each case the tubes open into the interior of the box sections of the main frame sill members where they have shut-off cocks 72 to isolate the panel air spaces. The top and bottom sill box sections thus serve as outlet and inlet manifolds for the pumped air flow.

The connections between successive panels in each vertical file indicated at 16 and 18 in FIG. 1 each comprise two tubes 80 which, in a similar manner to the inlet and outlet connections 70, are mounted in the hollow box-section main frame members through openings in the front walls of the members. The front end of each tube extends through an aperture in the web of a respective one of the two gaskets 44, to which it is sealed. The rear ends of each adjacent pair of tubes inside the main frame members are joined by a short U-shaped conduit 82 including a non-return valve to ensure that air can only pass from the lower to the upper of the spaces they interconnect. In the illustrated example there are two such vertical connections between each pair of neighbouring panels in a file; for maintenance and testing purposes inspection openings 84 with removable covers 86 are provided in the main frame transom members close to them, and each tube 80 has a shut-off cock 88 to allow pressure testing of the units to be performed.

At the reveals 90 that bound the curtain wall, there are fixed parallel pairs of ribs 92 with a sealing mastic 94 between them. The projecting ribs are engaged by and edge gasket 96 mounted between the main and auxiliary frame members in a similar manner to the panel gaskets. The edge gasket has front and rear portions of the same sectional form as the panel gaskets for engagement by and sealing with the frame members. The integral web 98 between these portions also carries a thicker intermediate portion 100 that has opposite ribbed sealing faces gripped between and engaging with the fixed ribs.

In the horizontal section of FIG. 3, the assembly illustrated is the same in many respects to the vertical section shown in FIG. 2. Additionally, there can be seen the blocking inserts 30 of a silicone mastic in the channel between the gasket web and the side edge of each panel to prevent a bypass flow through this channel that would diverts some airflow from the space between the two leaves of the panel. Such blocking means are placed in all the vertical passages formed by the gasket webs, including those of the edge gaskets 96 at the jamb mullions 4, as can be seen from FIG. 1. In addition, to assist equalisation of the flow between the vertical files, a connection 104 is provided between each laterally adjacent pair of panels. This comprises a short horizontal tube 106 between the adjacent gasket webs with reduced diameter screwed ends passing through holes in the webs. Nuts 108 threaded onto the screwed ends clamp sealing washers 110 against the edges of the holes.

In the operation of the venting system described, all the cocks 88 on the valved connectors for the peripheral spaces defined by the gasket webs are opened and the pump 20 and filter 22 produce a clean airflow that is directed into the bottom manifold 26 formed by the main frame member of the bottom sill, and from there through the spaces between the leaves of the panels to the upper manifold 28 formed by the main frame member of the upper sill to the discharge outlet. In its passage up the files the air is forced to flow through the spaces between the leaves and the lateral connections 104 help to spread the flow across the width of the structure.

While filtering the airflow can remove most foreign particles, it is preferred to reduce the possibility of adhesion of any residual particles or other deposits to the inner surfaces of the panel leaves if they are of a transparent or translucent nature, and it is possible to coat these surfaces with a silicone compound of a type known for making external glass surfaces easier to clean.

FIG. 4 illustrates a modified supply connection 18, in this case located in a mullion 2. Parts identical to those already described with reference to FIGS. 2 and 3 are indicated by the same reference numbers. An air supply tube 120 extends through the front web of the mullion box section 40 and is secured in place by locking nuts 122. The outer end of the tube 120 has threaded engagement to the stem of a T-piece 124. The oppositely directed arms of the T-piece project through the webs of the adjacent gaskets 44 and have screwed ends to fix and seal them in place using nuts 108 and sealing washers 110. An opening 128 at the rear of the box section gives access to the threaded inner end of the tube 120 for connecting it to the air supply circuit.

In the example described above connections are provided to establish a circulation of air thorugh the spaces between the panels. If the gas flow is not required for the prevention or removal of condensation it is only necessary in most instances to maintain a positive pressure in a closed volume. Outlet conduits are then not provided or are kept closed and consumption is limited to leakage losses.

This arrangement would be appropriate if the interconnected spaces are to be filled with gaseous media to make use of particular properties of such media, in particular for altering the physical characteristics of the wall. As an example, argon can be supplied to the spaces in the panels to give improved sound insulation. It has been shown that argon can give a dB reduction some 5 times greater than that of air. Other gasses may be employed to make use of their different physical attributes, e.g. for reducing the transmission of ultra violet light. Pre-dried air may be held in this way, simply to prevent condensation.

Figure 5:
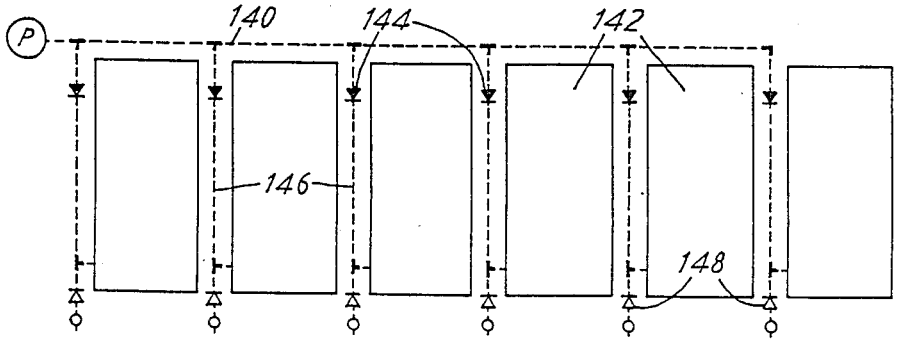
FIG. 5 is another schematic elevation of part of a curtain wall.

In the example illustrated schematically in FIG. 5 a supply conduit 140 is connected in parallel to a series of panels 142, in each case a non-return valve 144 being provided in the branch line 146 to the particular panel to isolate the panels from each other. The spaces within the panels can all be charged to a positive pressure and leakage from one will not draw gas from the others. The set-up shown in FIG. 5 also has test valves 148 connected to each branch line downstream of the non-return valve 144 because it illustrates, in fact, a pressure test system for checking the sealing integrity of the individual panels and their gaskets. The test valves may be simple core-type inflation valves, such as Schrader (Trade Mark) valves, and they permit a pressure gauge to be connected to each panel interior in turn. The flow pattern of FIG. 5 can be achieved using connections such as that shown in FIG. 4, with the rearwardly directed tube 120 containing a Schrader valve 148 and one of T-arms containing a check valve 144.

I claim:

1. A wall structure comprising a framework defining a series of cells, infill panels held in said cells and sealing means comprising continuous loop gaskets extending around the peripheral regions of respective panels in forming a chennel-like space around each of said panels, peripheral regions of said panels and said cells being adjacent each other and said sealing means being between said peripheral regions of the panels and the cells, at least one gorup of the panels comprising a plurality of layers, spacing means between said layers forming an internal space between adjacent layers of each panel of said group, conduit means connecting the peripheral regions of said group of plural-layer panels internally of said peripheral sealing means, and gas pumping means and a common inlet conduit from said gas pumping means for supplying a gas to said panel peripheral regions, outlet-conduit means from said group of panels whereby to establish between said layers a through-flow of gas from said pumping means by way of said inlet and outlet conduit means, and blocking means provided at least at one position in at least one of said peripheral regions to control gas flow therethrough.

2. A structure according to claim 1 wherein said spacer means provide communication between said internal spaces between the layers and said peripheral regions of the panels internally of said sealing means.

3. A structure according to claim 1 wherein the panels are connected together in a plurality of groups, each group having a respective inlet conduit, and cross-connection means are provided between at least two of the groups intermediate the gas path therethrough.

4. A structure according to claim 1 wherein the panels have lower edges on which they rest and substantially rigid hollow elements are disposed within the gaskets at said lower edges of the panels, support means being disposed externally of the gaskets below said hollow elements, whereby the weight of the panels is transmitted to said support means under the gaskets while maintaining open the channel-like spaces formed by said gaskets.

5. A structure according to claim 1 wherein said internal spaces are filled with a gaseous medium other than air.

* * * * *